US008776866B2

(12) United States Patent
Cederberg et al.

(10) Patent No.: US 8,776,866 B2
(45) Date of Patent: Jul. 15, 2014

(54) HEAT EXCHANGER PLATE AND A PLATE HEAT EXCHANGER

(75) Inventors: Anders Cederberg, Lund (SE); Peter Arndt, Höllviken (SE); Klas Bertilsson, Eslöv (SE); Anders Nyander, Staffanstorp (SE)

(73) Assignee: Alfa Laval Corporate AB, Lund (SE)

( * ) Notice: Subject to any disclaimer, the term of this patent is extended or adjusted under 35 U.S.C. 154(b) by 0 days.

(21) Appl. No.: 13/880,828

(22) PCT Filed: Oct. 3, 2011

(86) PCT No.: PCT/SE2011/051175

§ 371 (c)(1),
(2), (4) Date: May 10, 2013

(87) PCT Pub. No.: WO2012/053957

PCT Pub. Date: Apr. 26, 2012

(65) Prior Publication Data

US 2013/0233508 A1 Sep. 12, 2013

(30) Foreign Application Priority Data

Oct. 22, 2010 (SE) ..... 1051101

(51) Int. Cl.
*B60H 1/00* (2006.01)
*F28F 3/00* (2006.01)
*F28F 3/08* (2006.01)

(52) U.S. Cl.
USPC ..... 165/11.1; 165/166; 165/167

(58) Field of Classification Search
USPC ..... 165/11.1, 166, 167; 73/1.01, 46, 73/114.18, 865.9
See application file for complete search history.

(56) References Cited

U.S. PATENT DOCUMENTS 7,337,836 B1 3/2008 Persson
7,568,516 B2 8/2009 Bergqvist et al.
(Continued)

FOREIGN PATENT DOCUMENTS

DE 4100651 A1 7/1992
DE 102010015212 A1 11/2010
(Continued)

OTHER PUBLICATIONS

International Search Report (PCT/ISA/210) issued on Feb. 22, 2012, by the Swedish Patent Office as the International Searching Authority for International Application No. PCT/SE2011/051175.

(Continued)

*Primary Examiner* — Brandon M Rosati
*Assistant Examiner* — Jon T Schermerhorn
(74) *Attorney, Agent, or Firm* — Buchanan Ingersoll & Rooney PC

(57) ABSTRACT

The invention refers to a heat exchanger plate and a plate heat exchanger. The heat exchanger plates are arranged beside each other in the plate heat exchanger to define several first plate interspaces for a first medium and several second plate interspaces for a second medium. The heat exchanger plate comprises a heat transfer area, an edge area, which extends around and outside the heat transfer area, and a device, which is configured to receive or produce a signal. The heat exchanger plate also comprises a communication module comprising an electronic circuit connected to the device and communication means permitting communication of said signal with a master unit via at least a communication module of another heat exchanger plate in the plate package.

15 Claims, 3 Drawing Sheets

(56) References Cited

U.S. PATENT DOCUMENTS

| | | | | |
|---|---|---|---|---|
| 7,857,036 | B2 | 12/2010 | Bergqvist et al. | |
| 2008/0073054 | A1 * | 3/2008 | Bergqvist et al. | 165/11.1 |
| 2009/0151890 | A1 | 6/2009 | Bergqvist et al. | |

FOREIGN PATENT DOCUMENTS

| | | | |
|---|---|---|---|
| GB | 2171506 | A | 8/1986 |
| JP | 2-298797 | A | 12/1990 |
| JP | 2009-527854 | A | 7/2009 |
| JP | 2009-222400 | A | 10/2009 |
| WO | 99/51927 | A1 | 10/1999 |
| WO | WO 2005/119197 | A1 | 12/2005 |
| WO | 2010/071551 | A2 | 6/2010 |

OTHER PUBLICATIONS

Translation of the First Office Action issued on Mar. 18, 2014, by the Japanese Patent Office, in corresponding Japanese Patent Application No. 2013-534854. (3 pages).

Translation (KIPO'S Notice of Preliminary Rejection) Apr. 2, 2014, by the Korean Patent Office, in corresponding Korean Patent Application No. 10-2013-7010023. (2 pages).

* cited by examiner

HEAT EXCHANGER PLATE AND A PLATE HEAT EXCHANGER

TECHNICAL FIELD OF THE INVENTION

The present invention refers to a heat exchanger plate according to the preamble of claim 1. The invention also refers to a plate heat exchanger according to the preamble of claim 10. Such a heat exchanger plate and such a plate heat exchanger are disclosed in WO 2005/119197

BACKGROUND OF THE INVENTION AND PRIOR ART

There might be a desire to install different kinds of devices, such as sensors, probes, electronic devices, etc. on a large number of heat exchanger plates of the plate heat exchanger. Examples of devices could be for temperature measurement, pressure measurement, sending of any kind of pulses or signals and wide range of other applications.

WO 2005/119197 discloses a plate heat exchanger having a plurality of heat exchanger plates. Devices in the form of sensors are provided at respective plates in the proximity of a gasket for sealing the plate interspace. The sensors are provided for permitting monitoring of the compression of the gasket material.

SUMMARY OF THE INVENTION

A problem in connection with such or similar plate heat exchangers is that the plate heat exchanger frequently comprises a very large number of heat exchanger plates, in certain applications, up to and even more than 700 plates. If several or all plates are to be equipped with such a device the connection of those can be awkward. It is difficult to find appropriate positions and sufficient space for the installation of ordinary connection cables for all signals.

In addition, the mounting work will be highly time-consuming. In many applications, the plate heat exchangers with such devices and connections, may be exposed to aggressive cleaning, possibly at high pressure, which can lead to failures of the devices. The high amount of connections puts high demands of fuzz free electric contacts.

One object of the present invention is to remedy the problems discussed above and to provide a reliable plate heat exchanger having a large number of heat exchanger plates with such a device on a large number of or even all heat exchanger plates.

This object is achieved by means of the heat exchanger plate initially defined, which is characterised in that the heat exchanger plate comprises a communication module comprising an electronic circuit connected to the device, wherein the communication module also comprises communication means permitting communication of said signal with a master unit via at least a communication module of another heat exchanger plate in the plate package.

With such a heat exchanger plate it is possible to produce a plate heat exchanger with a reliable connection to the device also in the case that a large number of heat exchanger plates are included. The plate heat exchanger may be manufactured in an easy manner since no connection cables are needed for the communication with each of the devices. The freedom to position the communication module is high, since it does not have to be accessible for connection cables. The communication module may thus be positioned at a place which offer proper protection to the module, and at which it is not exposed to aggressive cleaning.

According to an embodiment of the invention, the communication module is configured to be comprised by a communication bus operating according to a suitable communication protocol, such as a serial bus protocol.

According to a further embodiment, the communication means comprises at least one primary contact element located on a primary side of the heat exchanger plate, and at least one secondary contact element located on an opposite secondary side of the heat exchanger plate. Such contact elements permits communication between the device and the master unit from one communication module to the adjacent communication module and so forth.

According to a further embodiment, the device comprises a sensor configured to sense at least one parameter and to produce a signal depending on the parameter. Such a sensor may comprise at least one of a pressure sensor, a temperature sensor, a moisture sensor etc.

According to a further embodiment, the device comprises a voltage generator configured to generate a voltage applied to the heat exchanger plate. Such a voltage generator may be provided for generating a voltage to the heat exchanger plate in order to avoid, reduce or even remove fouling of the plate.

According to a further embodiment, the communication module is provided in the edge area. In the edge area, the communication module is properly protected from the media flowing in the plate interspaces of the plate heat exchanger. The communication module may also in this position be easily accessible from outside.

According to a further embodiment, the heat exchanger plate comprises a gasket path, which extends around the heat transfer area between the heat transfer area and the edge area and is configured to receive a gasket, and an additional gasket path, which extends on the edge area and on which an additional gasket extends, wherein a space is formed between the gasket path and the additional gasket path, in which space the communication module is provided. With such a gasket arrangement, the communication module is properly protected also from external influences, such as cleaning liquids. According to a further embodiment, the heat exchanger plate comprises a number of portholes, which extend through the heat exchanger plate and are located inside the edge area, and preferably inside the gasket path, and in the proximity of the edge area.

According to a further embodiment, the heat exchanger plate comprises a cut-out in the edge area, wherein the communication module is provided in the cut-out. Such a cut-out, in the form of an opening or a recess, provides an advantageous position for the communication module, especially to permit the provision of the primary contact element on the primary side of the heat exchanger plate and the secondary contact element on the opposite secondary side of the heat exchanger plate. The cut-out may extend to the edge or be provided inside the edge of the heat exchanger plate.

The object is also achieved by the plate heat exchanger initially defined, which includes a plurality of heat exchanger plates defined above and being arranged beside each other to define several first plate interspaces for a first medium and several second plate interspaces for a second medium According to a further embodiment, the communication modules and the master unit are comprised by a communication bus operating according to a suitable communication protocol.

According to a further embodiment, the communication bus is a serial bus. Such a serial bus is suitable to permit the communication between the device and the master unit via consecutively provided communication modules communicating with each other via the primary contact on one side of the heat exchanger plate and the secondary contact on the other side of the heat exchanger plate.

According to a further embodiment, the communication modules are arranged in a daisy-chain circuit.

According to a further embodiment, the communication modules are consecutively arranged in the communication bus and have a respective address in the communication bus corresponding to the position of the communication module in the plate heat exchanger. In other words, the order of the communication modules, and thus of the heat exchanger plates, in the plate heat exchanger determines the address of the respective communication module.

According to a further embodiment, each communication module comprises a switch member configured to be closed when the communication module is initialised, thereby connecting the adjoining consecutive communication module to the communication bus and the master unit. Thus, the communication modules are arranged in a daisy-chain circuit.

Each communication module comprises a switch member configured to be in an open or closed position, wherein the communication module is initialised when the switch member is switched to the closed position, thereby connecting the adjoining consecutive communication module to the communication bus and the master unit. Advantageously, the switch member of the communication module in the closed position may be provided to connect the communication module to the communication bus and the master unit, thereby permitting the master unit to transfer an initialising signal via this communication module to an adjoining consecutive communication module so that this adjoining communication module is connected to the communication bus and the master unit.

According to a further embodiment, the master unit is provided on the plate heat exchanger. The master unit may comprise further communication means for communication with a further system, such as an overall control and/or monitoring system, via suitable cables or in a wireless mode. The master unit may also comprise a display or the like for displaying information to a user.

BRIEF DESCRIPTION OF THE DRAWINGS

The present invention will now be explained more closely by means of a description of various embodiments and with reference to the drawings attached hereto.

DETAILED DESCRIPTION OF VARIOUS EMBODIMENTS OF THE INVENTION

Figure 1:
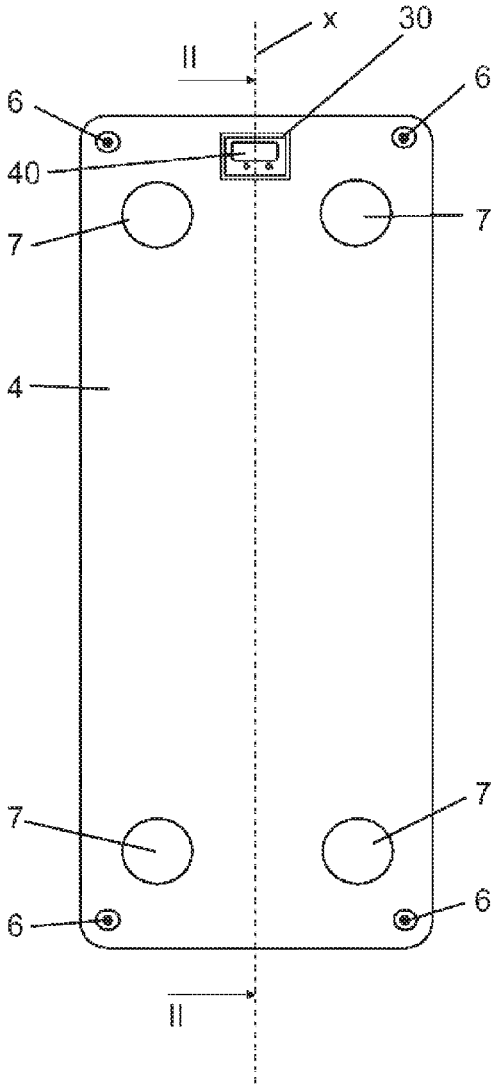
FIG. 1 discloses a front view of a plate heat exchanger comprising a plurality of heat exchanger plates according to a first embodiment of the invention.
Figure 2:
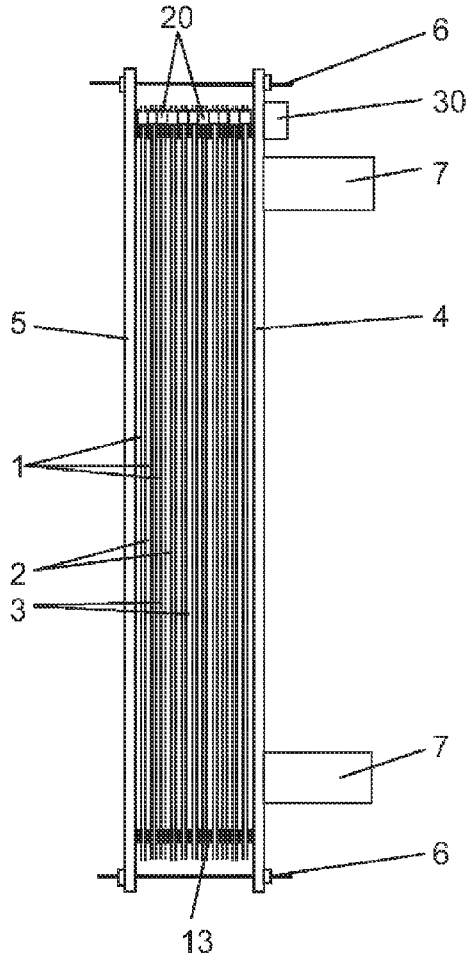
FIG. 2 discloses a side view of the plate heat exchanger along the line II-II in FIG. 1.

FIGS. 1 and 2 show a plate heat exchanger comprising a plurality of heat exchanger plates 1 forming a plate package. The heat exchanger plates 1 are arranged beside each other to define several first plate interspaces 2 for a first medium and several second plate interspaces 3 for a second medium. The first plate interspaces 2 and the second plate interspaces 3 are arranged in an alternating order in the plate package. The heat exchanger plates 1 of the plate package are pressed against each other between a frame plate 4 and a pressure plate 5 by means of tie bolts 6. In the embodiments disclosed, the plate heat exchanger comprises four porthole channels 7 forming an inlet and an outlet for the first medium and an inlet and an outlet for the second medium.

Figure 3:
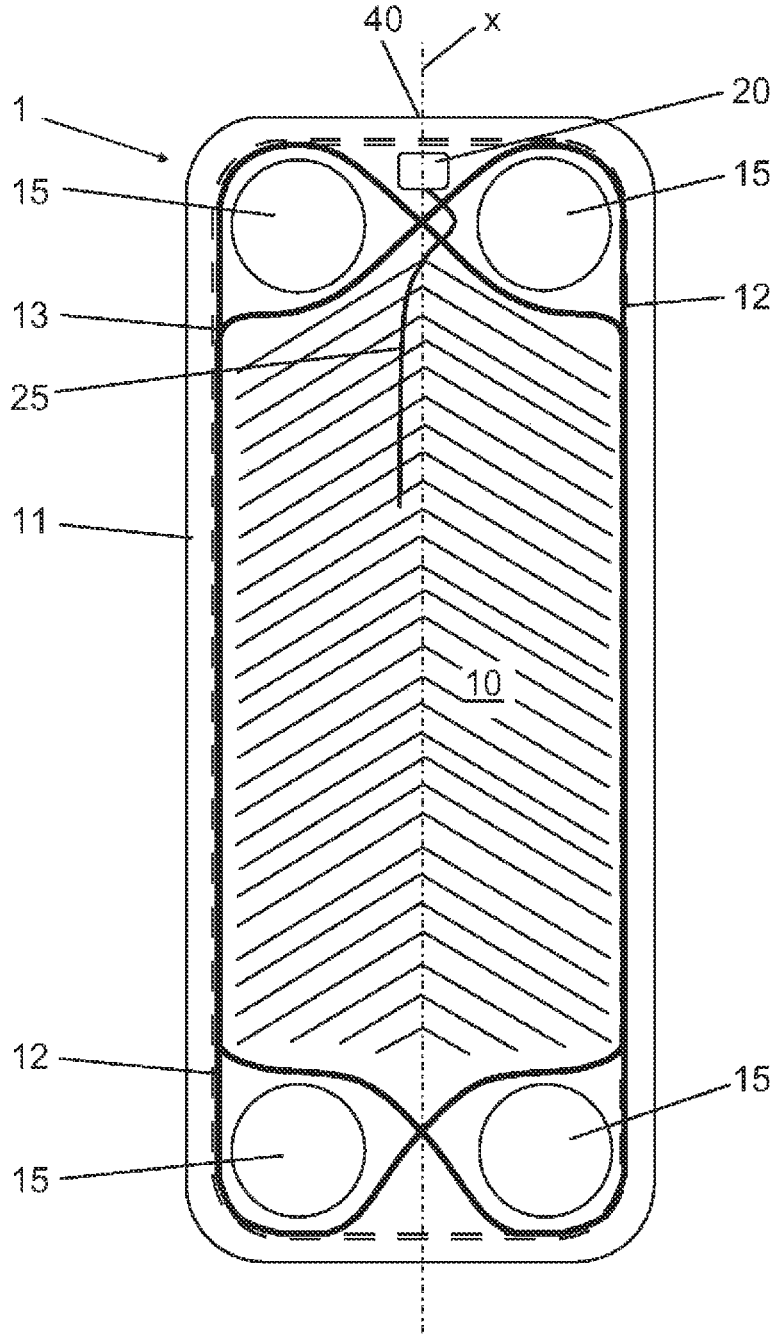
FIG. 3 discloses a front view of a heat exchanger plate of the plate heat exchanger in FIG. 1.

One of the heat exchanger plates 1 is disclosed in FIG. 3. The heat exchanger plate 1 comprises a heat transfer area 10, an edge area 11, which extends around and outside the heat transfer area 10. The edge area 11 comprises the outer surrounding edge of the heat exchanger plate 1. The heat exchanger plate 1 also comprises a gasket path 12, which extends around the heat transfer area 10 between the heat transfer area 10 and the edge area 11. A gasket 13 is provided on the gasket path 12 and extends around and encloses the heat transfer area 10.

Figure 4:
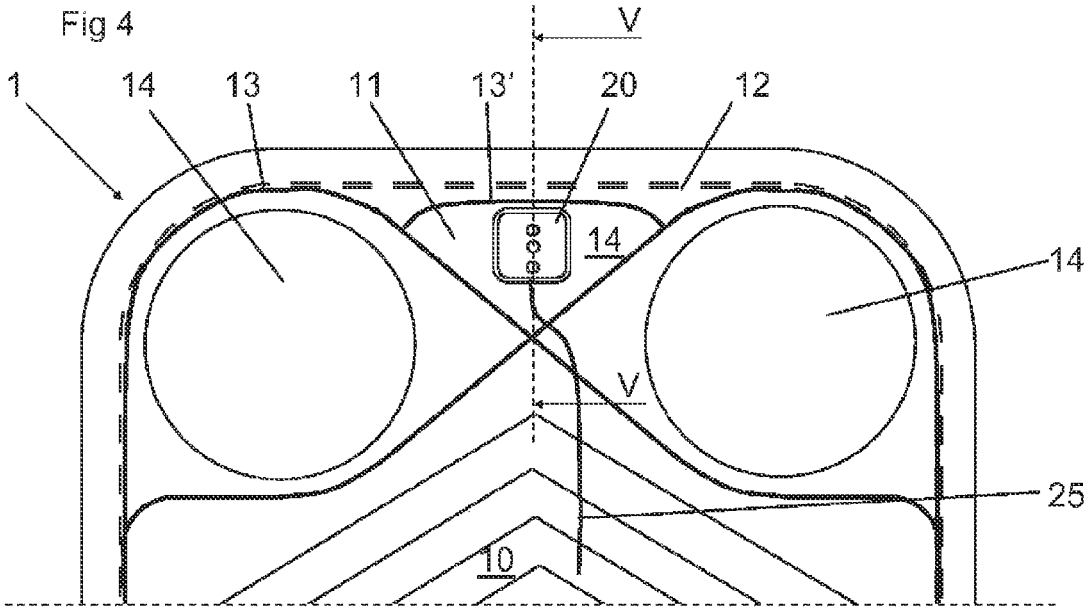
FIG. 4 discloses a front view of a part of the heat exchanger plate in FIG. 3.

The heat exchanger plate 1 may also comprise an additional gasket path 12', which extends on the edge area 11. An additional gasket 13' is provided on the additional gasket path 12', see FIG. 4. As can be seen in FIG. 4, a space 14 is formed between the gasket 13 and the additional gasket 13'. The space 14 is closed in relation to the environment and in relation to the plate interspaces 2, 3.

In the embodiments disclosed, four portholes 15 are provided and extend through the heat exchanger plate 1. The portholes 15 are located inside and in the proximity of the edge area 11. The portholes 15 are aligned with the porthole channels 7.

In the embodiments disclosed, the plate heat exchanger is thus mounted and held together by means of the tie bolts 6 and the gaskets 13, 13'. It is to be noted, however, that the invention is applicable also to plate heat exchangers of other kinds. The heat exchanger plates 1 may for instance be permanently connected to each other by means of welding, such as laser welding or electron beam welding, gluing or even brazing. An example of an alternative mounting of the heat exchanger plates 1, is a so called semi-welded plate heat exchanger where the heat exchanger plates are welded to each other in pairs, whereby the pairs of heat exchanger plates may be pressed against each other by means of tie bolts with gasket provided between the plates.

Figure 5:
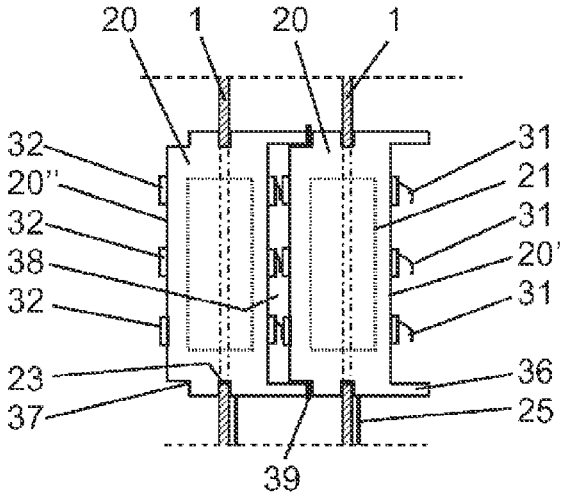
FIG. 5 discloses a sectional view along the line V-V in FIG. 4.

Each heat exchanger plate 1 comprises a communication module 20 comprising an electronic circuit 21, see FIG. 5, for instance in the form of a chip. The electronic circuit 21 is enclosed or embedded in a casing 22, which protects the electronic circuit 21 from being affected by external gases and liquids.

The communication module 20 is, in the embodiments disclosed, provided in the edge area 11. In the edge area 11, the communication module 20 is properly protected from the media flowing in the plate interspaces 2, 3 of the plate heat exchanger. Furthermore, the communication module 20 is in this position easily accessible from outside, as can be seen in FIG. 3. However, in the variant disclosed in FIG. 4, the communication module 20 is provided in the space 14. In the space 14, the communication module 20 is enclosed by the gasket 13 and the additional gasket 13', and thus separated also from the environment. The heat exchanger plate 1 comprises a cut-out 23 in the form of an opening or recess. The cut-out 23 is provided in the edge area 11, for instance in the space 14 as can be seen in FIG. 4. The communication module 20 is provided in the cut-out 23, which provides an advantageous position for the communication module 20. The cut-out 23 may extend to the edge or be provided inside the edge of the heat exchanger plate 1.

Each heat exchanger plate 1 comprises a device 25, which is configured to receive or produce a signal. In the embodiments disclosed the device 25 comprises or consists of a sensor for sensing a parameter, for instance a temperature sensor, a pressure sensor or a moisture sensor, and to produce a signal depending on the value of the sensed parameter. The sensor, or a sensor probe of the sensor, may be made of an electrically conducting material in the form of at least a wire, a strip, a foil or a net. The sensor, or sensor probe, may be attached to or provided on the heat exchanger plate 1 in the area where the parameter is to be sensed, for instance in the heat transfer area 10. The sensor, or the sensor probe, may comprise an insulating layer which insulates the sensor, or the sensor probe, from electric contact with the heat exchanger plate 1.

The device 25 communicates with, and is in the embodiments disclosed connected to, the electronic circuit 21 of the communication module 20 so that the signal can be communicated to or from the device 25. In case of a sensor, the signal is communicated to the communication module 20.

The communication module 20 also comprises communication means permitting communication of the signal with a master unit 30 via at least a communication module 20 of another heat exchanger plate in the plate package. The master unit 30 comprises a processor of any suitable kind. In the embodiment disclosed the master unit 30 is mounted to the plate heat exchanger, for instance on the frame plate 4 as indicated in FIGS. 1 and 2.

The communication means of the communication modules 20 of the heat exchanger plates 1, and the master unit 30 form or comprise a communication bus operating according to a suitable communication protocol. In the embodiments disclosed, the communication bus is a serial bus. The communication in the communication bus is initiated, monitored and controlled via or by the master unit 30.

In the first embodiment, each communication module 20 also comprises a suitable number of primary contact elements 31 located on a primary side 20' of the communication module 20 and on a primary side of the heat exchanger plate 1, and secondary contact elements 32 located on an opposite secondary side 20' of the communication module 20 and on a secondary side of the heat exchanger plate 1. In the embodiment disclosed in FIGS. 5 and 6, the communication module 20 comprises three primary contact element 31 and three secondary contact elements 32. When the heat exchanger plates 1 are compressed to each other the primary contact elements 31 of one of the heat exchanger plates 1 will be in electrical contact with the secondary contact elements 32 of an adjoining heat exchanger plate 1, as can be seen in FIG. 5. In the first embodiment, the primary contact elements 31 are configured as spring members ensuring a proper electrical contact with the corresponding secondary contact elements 32 when the heat exchanger plates 1 are pressed together.

The master unit 30 may comprise corresponding secondary contact elements 32, which are provided on or extend to the inner side of the frame plate 4. These secondary contact elements 32 may be brought into electrical contact with the primary contacts 31 of the outermost communication module 20 when the plate heat exchanger is assembled.

In the embodiments disclosed, a first pair of the primary contact 31 and the secondary contacts 32 of one communication module 20 is provided for a power line 33 for the supply of electric power to the communication module 20. A second pair of the primary contact 31 and the secondary contacts 32 is provided for a signal line 34 for the various signals to be transferred. A third pair of the primary contact 31 and the secondary contacts 32 is provided for a ground line 35 for connecting the communication module 20 to the ground.

The communication module 20 may comprise only one primary contact element 31 and only one secondary contact element 32, wherein the electrical connection to the ground may be provided via the heat exchanger plates 1. The power and signal line may be combined to a single line, for instance using different current levels for the power and the signalling. The communication module 30 may also comprise two, four or more primary contact elements 31 and secondary contact elements 32.

The communication modules 20 are configured be attached or joined to each other when the heat exchanger plates are arranged beside each other in the plate package. The casing 22 of each communication module 20 comprises a surrounding flange 36 extending from the primary side 20' and a surrounding recess 37 on the secondary side 20". When the heat exchanger plates 1 are pressed together, the recess 37 of one communication module 20, permits the secondary side 20" of this communication module 20 to be fitted inside the surrounding flange 36 of the adjoining communication module 20, as can be seen in FIG. 5. In such a manner, a closed space 38 is created between the primary side 20' of one communication module 20 and the secondary side 20" of the adjoining communication module 20. The primary contact elements 31 and the secondary contact elements 32 being in electrical contact with each other are thus enclosed in the closed space 38 and protected from the environment. The fitting between the adjoining communication modules 20 is preferably configured to be tight to prevent any liquids from penetrating the closed space 38. Advantageously a gasket 39, or any other suitable sealing member, may be provided between the surrounding recess 37 and the surrounding flange 36 in order to obtain a proper sealing of the closed space. According to a further alternative, the casing 22 of the communication module 20 may be made of a soft flexible material, such as an elastic polymer material, that provides a sealing function between the recess 37 and the flange 36.

Signals from each of the devices 25 may thus be communicated to the master unit 30 via the respective communication module 20 and the communication bus. The master unit 30 is thus configured to receive and process the signals from the devices 23 of all the heat exchanger plates 1. The master unit 30 may comprise a display 40 for displaying information to a user, see FIG. 1. The master unit 30 may also comprise means for communication with other systems, such as an overall control or monitoring system.

The communication bus, operating according to a suitable serial communication protocol, is configured to permit the communication between the device 25 and the master unit 30 via the communication modules 20. The communication modules 20 are arranged consecutively after each other, so that the signal is transferred between the master unit 30 and the communication module and device 25 concerned via the communication modules provided between the master unit 30 and the communication module 20 concerned.

The communication modules 20 are thus consecutively arranged in the communication bus and have a respective address in the communication bus corresponding to the position of the communication module 20 in the plate heat exchanger. In other words, the order of the communication modules 20 in the plate heat exchanger determines the address of the respective communication module 20.

Figure 6:
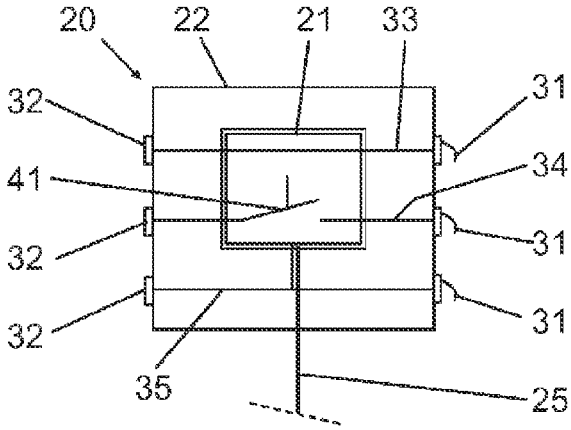
FIG. 6 schematically a communication module of the heat exchanger plate in FIG. 3.

Each communication module 20 comprises a switch member 41, see FIG. 6, which is configured to be open before the communication bus has been initialised and started, and to be closed when the communication module 20 is initialised by means of a signal from the master unit 30. The communication modules 20, or the electronic circuits 21 of the communication modules 20, are arranged in a daisy-chain circuit.

When one of the communication modules 20 has been initialised, the switch member 41 of this communication module 20 is closed so that it is connected to the communication bus and the master unit 30. The master unit 30 then transfer an initialising signal via this communication module 20 to the adjoining consecutive communication module 20 so that this adjoining communication module 20 is connected to the communication bus and the master unit 30. This is repeated until no more non-initialised communication modules 20 answers to the initialising signal. The master unit 30 now knows in which order the communication modules 20 are positioned, and communication module 20 may thus be identified and addressed by the master unit 30 by means of its position in the plate package. Consequently, no unique identification code for each communication module 20 is required, since the communication bus and the individual communication modules 20 are automatically configured during initialisation and start up.

This means that all communication modules 20 may be identical. Furthermore, this has the advantage that any heat exchanger plate 1 with a communication module 20 may be provided in any position in the plate heat exchanger, since its address in the communication bus is automatically given during the initialisation.

As mentioned above, the master unit 30 initiates the communication bus and gives addresses to the communication modules 20. Most of the logic signal handling and the alarm handling may be made in and by the master unit 30. This reduces the complexity and the costs for the communication modules 20, and thus for the heat exchanger plates 1. It also reduces the amount of information to be sent over the communication bus. For instance, a sensor of the device 25 may communicate only the actual value of the parameter sensed, while the alarm limit and the identification of alarm is handled by the master unit 30. In this way it is easy to change alarm limits. Thanks to the unique address of each communication module 20, it is possible for the master unit 30 to tell the operator, for instance via the display 40 or the overall control or monitoring system, not only that an alarm has occurred, but also to indicate on which plate the alarm is created.

According to another embodiment, the device 25 comprises a voltage generator configured to generate a voltage, which may be applied to the heat exchanger plate 1. Such a voltage may be applied in order to avoid or remove fouling on the heat exchanger plates 1, especially in the heat transfer area 10. In this embodiment, the communication bus is configured to transfer the voltage from the master unit 30, or any suitable voltage source connected to the master unit 30, to the individual communication modules 20 with the respective heat exchanger plate 1.

In a further embodiment, the heat exchanger plates 1 are double wall plates formed by two adjoining plates compressed to be in contact with each other. With such a double wall plate, the device 25, for instance in the form of a sensor of the above mentioned kind, may be provided between the adjoining plates of the heat exchanger plate 1.

The present invention is not limited to the embodiments disclosed but may be varied and modified within the scope of the following claims.

The invention claimed is:

1. A heat exchanger plate for a plate heat exchanger, comprising a heat transfer area, an edge area, which extends around and outside the heat transfer area, and a device, which is configured to receive or produce a signal, wherein the heat exchanger plate comprises a communication module comprising an electronic circuit connected to the device, wherein the communication module also comprises communication means permitting communication of said signal with a master unit via at least a communication module of another heat exchanger plate in the plate heat exchanger, and the communication means comprises at least one primary contact element located on a primary side of the heat exchanger plate, and at least one secondary contact element located on an opposite secondary side of the heat exchanger plate.

2. A heat exchanger plate according to claim 1, wherein the communication module is configured to be comprised by a communication bus operating according to a suitable communication protocol.

3. A heat exchanger plate according to claim 1, wherein the device comprises a sensor configured to sense at least one parameter and to produce a signal depending on the parameter.

4. A heat exchanger plate according to claim 1, wherein the device comprises a voltage generator configured to generate a voltage applied to the heat exchanger plate.

5. A heat exchanger plate according to claim 1, wherein the communication module is provided in the edge area.

6. A heat exchanger plate according to claim 1, comprising a gasket path, which extends around the heat transfer area between the heat transfer area and the edge area and is configured to receive a gasket, and an additional gasket path, which extends on the edge area and on which an additional gasket extends, wherein a space is formed between the gasket path and the additional gasket path, in which space the communication module is provided.

7. A heat exchanger plate according to claim 1, comprising a cut-out in the edge area, wherein the communication module is provided in the cut-out.

8. A plate heat exchanger, comprising a plurality of heat exchanger plates according to claim 1, the heat exchanger plates being arranged beside each other to define several first plate interspaces for a first medium and several second plate interspaces for a second medium.

9. A plate heat exchanger according to claim 8, wherein the communication modules and the master unit are comprised by a communication bus operating according to a suitable communication protocol.

10. A plate heat exchanger according to claim 9, wherein the communication bus is a serial bus.

11. A plate heat exchanger according to claim 9, wherein the communication modules are arranged in a daisy-chain circuit.

12. A plate heat exchanger according to claim 9, wherein the communication modules are consecutively arranged in the communication bus and have a respective address in the communication bus corresponding to the position of the communication module in the plate heat exchanger.

13. A plate heat exchanger according to claim 12, wherein each communication module comprises a switch member configured to be in an open or closed position, and wherein the communication module is initialised when the switch member switched to the closed position, thereby connecting the adjoining consecutive communication module to the communication bus and the master unit.

14. A plate heat exchanger according to claim 13, wherein the switch member of the communication module in the closed position is provided to connect the communication module to the communication bus and the master unit, thereby permitting the master unit to transfer an initialising signal via this communication module to an adjoining consecutive communication module so that this adjoining communication module is connected to the communication bus and the master unit.

15. A plate heat exchanger according to claim 8, wherein the master unit is provided on the plate heat exchanger.

* * * * *